US007578924B1

(12) United States Patent
Jiang et al.

(10) Patent No.: US 7,578,924 B1
(45) Date of Patent: Aug. 25, 2009

(54) PROCESS FOR PRODUCING HIGH ETCH GAINS FOR ELECTROLYTIC CAPACITOR MANUFACTURING

(75) Inventors: Xiaofei Jiang, Liberty, SC (US); Tearl Stocker, Easley, SC (US); R. Jason Hemphill, Pickens, SC (US); Thomas F. Strange, Easley, SC (US)

(73) Assignee: Pacesetter, Inc., Sunnyvale, CA (US)

( * ) Notice: Subject to any disclaimer, the term of this patent is extended or adjusted under 35 U.S.C. 154(b) by 719 days.

(21) Appl. No.: 10/903,958

(22) Filed: Jul. 29, 2004

(51) Int. Cl.
*C25F 3/02* (2006.01)

(52) U.S. Cl. ..... 205/674; 205/640

(58) Field of Classification Search ..... 205/640, 205/674

See application file for complete search history.

(56) References Cited

U.S. PATENT DOCUMENTS

| | | | | | |
|---|---|---|---|---|---|
| 3,662,843 | A | | 5/1972 | Wise | 173/131 |
| 3,872,579 | A | | 3/1975 | Papadopoulos | 29/570 |
| 4,213,835 | A | | 7/1980 | Fickelscher | 204/129.25 |
| 4,266,332 | A | | 5/1981 | Markarian et al. | 29/570 |
| 4,381,231 | A | * | 4/1983 | Arora | 205/674 |
| 4,420,367 | A | | 12/1983 | Locher | 156/651 |
| 4,427,506 | A | | 1/1984 | Nguyen et al. | 204/129.4 |
| 4,474,657 | A | | 10/1984 | Arora | 204/129.75 |
| 4,518,471 | A | | 5/1985 | Arora | 204/129.1 |
| 4,525,249 | A | | 6/1985 | Arora | 204/129.75 |
| 4,541,037 | A | | 9/1985 | Ross et al. | 361/433 |
| 4,582,574 | A | * | 4/1986 | Nguyen et al. | 205/153 |
| 4,588,486 | A | * | 5/1986 | Nguyen et al. | 205/646 |
| 4,593,343 | A | | 6/1986 | Ross | 361/433 |
| 4,663,824 | A | | 5/1987 | Kenmochi | 29/570 |
| 4,696,082 | A | | 9/1987 | Fonfria et al. | 29/25.42 |
| 5,131,388 | A | | 7/1992 | Pless et al. | 128/419 D |
| 5,405,493 | A | * | 4/1995 | Goad | 205/661 |
| 5,715,133 | A | * | 2/1998 | Harrington et al. | 361/500 |
| 5,901,032 | A | | 5/1999 | Harrington et al. | 361/500 |
| 6,224,738 | B1 | * | 5/2001 | Sudduth et al. | 205/221 |
| 6,238,810 | B1 | * | 5/2001 | Strange et al. | 428/687 |
| 2002/0092777 | A1 | * | 7/2002 | Yoshimura et al. | 205/644 |

FOREIGN PATENT DOCUMENTS

JP 2001314712 A * 11/2001

OTHER PUBLICATIONS

Dukhin, et al., "Acoustic and Electroacoustic Spectroscopy for Characterizing Concentrated Dispersions and Emulsions", Advances in Colloid and Interface Science 92 (2001) 73-132.

Dunkhin, et al., "Ultrasound for Characterizing Colloids, Particle Sizing, Zeta Potential, Rheology", Dispersion Technology, Inc., NY, USA, First Edition, 2002, 18 pages.

* cited by examiner

*Primary Examiner*—Harry D. Wilkins, III
*Assistant Examiner*—Nicholas A. Smith
(74) *Attorney, Agent, or Firm*—Theresa A. Takeuchi; Steven M. Mitchell

(57) ABSTRACT

Anode foil, preferably aluminum anode foil, is etched using a process of treating the foil in an electrolyte bath composition comprising a sulfate and a halide, such as sodium chloride. The anode foil is etched in the electrolyte bath composition by passing a charge through the bath. The etched anode foil is suitable for use in an electrolytic capacitor.

34 Claims, 4 Drawing Sheets

PROCESS FOR PRODUCING HIGH ETCH GAINS FOR ELECTROLYTIC CAPACITOR MANUFACTURING

BACKGROUND OF THE INVENTION

1. Field of the Invention

The present invention relates generally to an etch electrolyte composition and method for etching anode foil to render it suitable for use in electrolytic capacitors, and to such electrolytic capacitors.

2. Related Art

Compact, high voltage capacitors are utilized as energy storage reservoirs in many applications, including implantable medical devices. These capacitors are required to have a high energy density since it is desirable to minimize the overall size of the implanted device. This is particularly true of an implantable cardioverter defibrillator (ICD), also referred to as an implantable defibrillator, since the high voltage capacitors used to deliver the defibrillation pulse can occupy as much as one third of the ICD volume.

Implantable cardioverter defibrillators, such as those disclosed in U.S. Pat. No. 5,131,388, incorporated herein by reference, typically use two electrolytic capacitors in series to achieve the desired high voltage for shock delivery. For example, an implantable cardioverter defibrillator may utilize two 350 to 400 volt electrolytic capacitors in series to achieve a voltage of 700 to 800 volts.

Electrolytic capacitors are used in ICDs because they have the most nearly ideal properties in terms of size and ability to withstand relatively high voltage. Conventionally, an electrolytic capacitor includes an etched aluminum foil anode, an aluminum foil or film cathode, and an interposed kraft paper or fabric gauze separator impregnated with a solvent-based liquid electrolyte. The electrolyte impregnated in the separator functions as the cathode in continuity with the cathode foil, while an oxide layer on the anode foil functions as the dielectric.

In ICDs, as in other applications where space is a critical design element, it is desirable to use capacitors with the greatest possible capacitance per unit volume. Since the capacitance of an electrolytic capacitor increases with the surface area of its electrodes, increasing the surface area of the aluminum anode foil results in increased capacitance per unit volume of the electrolytic capacitor. By electrolytically etching aluminum foils, an enlargement of a surface area of the foil will occur. As a result of this enlargement of the surface area, electrolytic capacitors, which are manufactured with the etched foils, can obtain a given capacity with a smaller volume than an electrolytic capacitor which utilizes a foil with an unetched surface.

In a conventional electrolytic etching process, surface area of the foil is increased by removing portions of the aluminum foil to create etch tunnels. While electrolytic capacitors having anodes and cathodes comprised of aluminum foil are most common, anode and cathode foils of other conventional valve metals such as titanium, tantalum, magnesium, niobium, zirconium and zinc are also used. Electrolytic etching process are illustrated in U.S. Pat. Nos. 4,213,835, 4,420,367, 4,474,657, 4,518,471 4,525,249, 4,427,506, and 5,901,032.

In conventional processes for etching aluminum foil, an electrolytic bath is used that contains a persulfate oxidizing agent, such as sodium persulfate. The etching is usually followed by treatment in nitric or hydrochloric acid. Sodium persulfate is a strong oxidizing agent which can control the etch process to initiate more tunnels per unit area, and can also prevent the etch tunnel walls from being completely passivated during etch. However, sodium persulfate is thermally and electrochemically unstable and tends to decompose to sodium sulfate over time at high solution temperature. Also, sodium persulfate, if not isolated from the cathode, tends to be unduly reduced at the cathode to form sodium sulfate. Above a certain concentration, sodium sulfate is believed to be detrimental to the foil capacitance. Thus, a high standard deviation in foil capacitance can occur if the persulfate and resulting sulfate levels are not tightly controlled. Accordingly, to maintain a high capacitance yield, sodium persulfate needs to be replenished in the etch solution, and the level of sodium sulfate must be controlled (i.e., removed from the etch solution).

It would be advantageous to utilize an etch process, particularly for a direct current (DC) etch process, which provides for a high voltage, high capacitance yield using agents that are more chemically stable than persulfate.

SUMMARY OF THE INVENTION

The present invention provides improved methods and compositions for the etching of anode foils, as well as electrolytic capacitors comprising this foil. An embodiment of invention provides a method for etching an anode foil by treating the foil in an aqueous electrolyte bath composition comprising a sulfate and a halide, and passing a charge through the anode foil while the foil is immersed in the electrolyte bath. The method includes treating the foil in an aqueous electrolyte bath composition that includes a viscosity-modifying agent, such as, e.g., glycerin, and an additional oxidizing agent, such as, e.g., a perchlorate.

In another embodiment of the invention, the anode foil is precleaned prior to treating the foil in an aqueous electrolyte bath composition. Precleaning is conducted by immersing the foil in a corrosive composition, such as hydrochloric acid.

Another embodiment of the invention is directed to an aqueous electrolyte bath composition for etching anode foil. The composition includes a sulfate, a halide, and a surface-active, viscosity-modifying agent. The composition may include a chloride, such as sodium chloride, glycerin, and an additional oxidizing agent such as a perchlorate, e.g., sodium perchlorate.

In contrast to use of a persulfate in etch processes, it has been discovered that a sulfate, which is thermally and electrochemically stable, can be used in etch processes to obtain a high capacitance yield in a stable etch solution that is easy to maintain. Accordingly, the present invention provides improved methods and compositions for etching anode foil, as well as electrolytic capacitors comprising this foil.

BRIEF DESCRIPTION OF THE DRAWINGS/FIGURES

DETAILED DESCRIPTION OF THE INVENTION

Figure 1A:
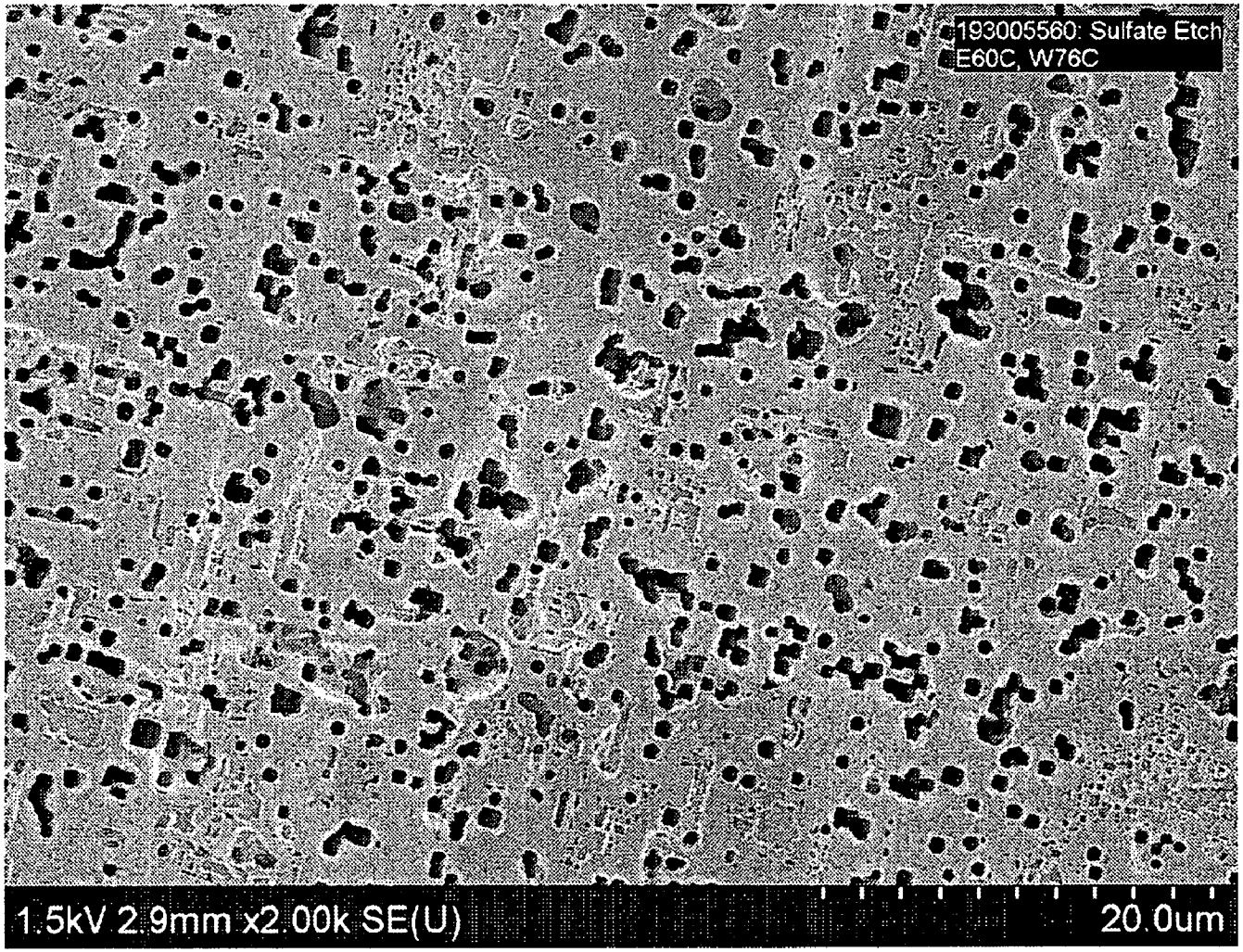
FIGS. 1A and 1B illustrate SEM images of sulfate etched foil surface after electropolishing, according to the present invention.

The present invention provides etching of aluminum anode foil to increase surface area and capacitance. Several factors contribute to increasing the specific capacitance of aluminum electrolytic capacitor foil. One factor is the amount of increase in tunnel density (i.e., the number of tunnels per square centimeter). As tunnel density is increased, a corresponding enlargement of the overall surface area will occur. Another factor controlling the increase in specific capacitance is the length of the etch tunnel. Longer tunnels or through tunnels result in higher surface area. The tunnel density and tunnel length are both determined by the type of etch process.

In the method of the present invention, the foil can be etched anodically under the influence of a charge in an electrolyte bath. In particular, the foil can be etched by treating the anode foil in an electrolyte bath composition comprising a sulfate and a halide, and passing a charge through the anode foil while the foil is immersed in the electrolyte bath.

The electrolytic bath composition of the present invention contains a sulfate ($SO_4^{2-}$). Suitable sulfates include sodium sulfate, potassium sulfate, and lithium sulfate, or other soluble sulfate salts, with sodium sulfate preferred. The amount of sulfate in the electrolytic bath composition can range from about 100 parts per million (ppm) to about 2000 ppm (e.g. ranging from about 250 ppm to about 1000 ppm), from about 500 ppm to about 700 ppm being preferred.

The electrolyte bath composition also contains a halide. The type of halide is not particularly limited, so long as the halide ion is provided to interact with the sulfate. The halide is believed to help provide for pit initiation and tunnel propagation of the anode foil. A preferred halide is sodium chloride. The amount of the halide ranges from about 1% to about 6% by weight of the electrolyte bath composition, more preferably ranging from about 1% to about 3% by weight.

The electrolyte bath composition may include an additional oxidizing agent that is used in conjunction with the halide, for example iodic acid, iodine pentoxide, iodine trichloride, sodium perchlorate, sodium peroxide, hydrogen peroxide, sodium pyrosulfate, and mixtures thereof. Preferably, the oxidizing agent is thermally stable and/or chemically stable, e.g. it is not unduly reduced at the cathode, and helps to create high tunnel density and long tunnels for the etched foil. A preferred oxidizing agent is sodium perchlorate. For example, sodium perchlorate can be used in conjunction with a halide, e.g., sodium chloride.

The amount of oxidizing agent ranges from about 2% to about 12% by weight of the electrolyte bath composition, more preferably ranging from about 2% to about 6% by weight. Preferably, the weight ratio of halide to oxidizing agent is at about 2 to 1.

As an example, the amount of sodium perchlorate can range from about 2% to about 12% by weight of the electrolyte bath composition, more preferably ranging from about 2% to about 6% by weight. Similarly, the amount of sodium chloride can range from about 1% to about 6% by weight of the electrolyte bath composition; more preferably ranging from about 1% to about 3% by weight. Illustratively, the weight ratio of sodium perchlorate to sodium chloride is about 2 to 1.

In another embodiment of the invention, in addition to a sulfate and a halide, or in addition to a sulfate, a halide, and an additional oxidizing agent, the electrolyte bath composition contains a surface-active, viscosity-modifying agent. Suitable surface-active, viscosity-modifying agents are described in U.S. Pat. No. 6,238,810. Such agents include ethylene glycol, butoxyethanol (butyl cellosolve), and glycerin (also referred to herein as glycerol), with glycerin being preferred.

The amount of surface-active, viscosity-modifying agent can range from about 0.5% to about 50% by weight of the electrolyte bath composition (e.g. about 5% to about 30% by weight). Preferably, the surface-active, viscosity-modifying agent is present in the amount of about 20% by weight of the electrolyte bath composition.

For example, foil capacitance is expected to increase with increasing amounts of glycerin up to about 20% by weight of the electrolyte bath composition. Above the 20% by weight glycerin level, foil capacitance is expected to plateau and then drop when the glycerin level is above 22% by weight.

An illustrative electrolytic bath composition for use in the present invention comprises about 500 ppm sulfate, about 2.6% by weight sodium perchlorate, about 1.3% by weight sodium chloride, and about 20% by weight glycerin.

In the method of the present invention, the foil can be etched anodically under the influence of an electrical charge in an electrolyte bath, preferably by a direct current (DC). The use of a DC charge will be discussed below.

The electrolyte bath composition is heated to a temperature ranging from about 60° C. and 95° C. (e.g. about 75° C. and about 85° C.), with about 80° C. to 81° C. preferred. Illustratively, foil capacitance is expected to increase with increasing temperature, with a peak capacitance in the range of about 80° C. to about 81° C.

The foil (preferably a high purity, high cubicity etchable strip as supplied by vendors known to those in the art, and also as discussed below) is inserted into the electrolyte bath composition of the present invention and etched at a DC charge density in an amount ranging from about 0.1 to about 0.5 $A/cm^2$ (e.g., ranging from about 0.1 to about 0.4 $A/cm^2$, or from about 0.1 to 0.3 $A/cm^2$), with about 0.15 $A/cm^2$ preferred. The etching can be carried out with an etching charge ranging from about 20 to about 100 $coulombs/cm^2$ (e.g. ranging from about 40 to about 80 $coulombs/cm^2$, or about 60 to about 80 $coulombs/cm^2$, or about 60 to about 70 $coulombs/cm^2$), with a range of about 60 to about 70 $coulombs/cm^2$ preferred. The time for which the foil is etched ranges from about 2 minutes to about 11 minutes (e.g., about 2 minutes, 13 seconds to about 11 minutes, 6 seconds), with about 6½ to about 7½ minutes preferred (e.g., about 6 minutes, 40 seconds to about 7 minutes, 47 seconds). As is understood by those skilled in the art, the etch charge and time will depend upon the specific applications for which the foil is to be used.

In an embodiment of the invention, the etch electrolyte bath composition is maintained at a solids level in an amount ranging from about 5 g/L to about 40 g/L. For example, when aluminum foil is etched according to the methods of the present invention, a portion of the solid aluminum hydroxide generated during etching may be removed from the electrolyte bath composition by passing the composition through a medium with a pore size sufficient to filter the solids to an acceptable level. For example, the porous medium may have a pore size ranging from about 25 microns and about 40 microns.

In another embodiment of the invention, the foil is precleaned prior to etching. By "precleaning" it is meant that the foil, preferably aluminum foil, is activated by partly removing the natural oxide or contamination and reveals portions of the fresh aluminum surface on which sulfate ions can promote tunnel initiation. Proper precleaning prior to etching results in an increased capacity for the resulting etched foil.

Precleaning of the foil is accomplished by immersing the foil in a corrosive solution, such as HCl, $H_2SO_4$, $H_3PO_4$, or other commercially available solutions such as the Hubbard-Hall Lusterclean solution for a time sufficient to partly expose the fresh aluminum metal on the foil. For example, the foil can be immersed in an aqueous solution containing HCl in an amount ranging from about 0.1% to about 2% by weight (e.g. from about 0.1 to about 1% by weight, or about 0.2% to about 0.5% by weight), preferably about 0.2% by weight, for a time ranging from about 20 seconds to about 2 minutes (e.g. from about 20 seconds to about 1 minute), preferably about 20 seconds. The foil is preferably immersed in the corrosive solution at room temperature (e.g., about 20 to about 30° C.). The foil may then be rinsed with water, preferably deionized water, for at least about one minute.

The foil used for etching according to the present invention is preferably etchable aluminum strip of high cubicity. High cubicity in the context of the present invention is where at least 80% of crystalline aluminum structure is oriented in a normal position (i.e., a (1,0,0) orientation) relative to the surface of the foil. The foil used for etching is also preferably of high purity. Such foils are well-known in the art and are readily available from commercial sources. Illustratively, the thickness of the aluminum foil ranges from about 50 to about 200 microns, preferably from about 110 microns to about 114 microns.

After etching, the foil is removed from the etch solution and rinsed in deionized water. The tunnels formed during the initial etch are then widened, or enlarged, in a secondary etch solution, typically an aqueous based nitrate solution, preferably between about 1% to about 20% aluminum nitrate, more preferably between about 10% to about 14% aluminum nitrate, with less than about 1% free nitric acid. The etch tunnels are widened to an appropriate diameter by methods known to those in the art, such as that disclosed in U.S. Pat. No. 4,518,471 and U.S. Pat. No. 4,525,249, both of which are incorporated herein by reference. In embodiments of the invention, the widening charge ranges from about 60 to about 90 coulombs/$cm^2$, more preferably about 70 to about 80 coulombs/$cm^2$.

After the etch tunnels have been widened, the foil is again rinsed with deionized water and dried. Finally, a barrier oxide layer is formed onto the metal foil by placing the foil into an electrolyte bath and applying a positive voltage to the metal foil and a negative voltage to the electrolyte. The barrier oxide layer provides a high resistance to current passing between the electrolyte and the metal foils in the finished capacitor, also referred to as the leakage current. A high leakage current can result in the poor performance and reliability of an electrolytic capacitor. In particular, a high leakage current results in greater amount of charge leaking out of the capacitor once it has been charged.

The formation process consists of applying a voltage to the foil through an electrolyte such as boric acid and water or other solutions familiar to those skilled in the art, resulting in the formation of an oxide on the surface of the anode foil. The preferred electrolyte for formation is a 100-1000 μS/cm, preferably 500 μS/cm, citric acid concentration. In the case of an aluminum anode foil, the formation process results in the formation of aluminum oxide ($Al_2O_3$) on the surface of the anode foil. The thickness of the oxide deposited or "formed" on the anode foil is proportional to the applied voltage, roughly 10 to 15 Angstroms per applied volt. The formation voltage can be about 250 Volts or higher, preferably about 250 Volts to about 600 Volts, more preferably about 450 Volts to about 510 Volts. The etched and formed anode foils can then be cut and used in the assembly of a capacitor.

The present invention thus also provides electrolytic capacitors comprising etched anode foil etched by methods and/or compositions according to the present invention. Such capacitors can be made using any suitable method known in the art. Non-limiting examples of such methods are disclosed, e.g., in the following references which are entirely incorporated herein by reference: U.S. Pat. Nos. 4,696,082 to Fonfria et al., 4,663,824 to Kemnochi, 3,872,579 to Papadopoulos, 4,541,037 to Ross et al., 4,266,332 to Markarian et al., 3,622,843 to Vermilyea et al., and 4,593,343 to Ross. The rated voltage of the electrolytic capacitor is preferably above about 250 Volts, such as, e.g. between about 250 Volts and 1000 Volts. Preferably, the voltage is about 400 Volts or higher, more preferably about 400 to about 550 Volts. Illustrative capacitance is about 1.0 μF/$cm^2$ to about 1.4 μF/$cm^2$.

The process of the present invention results in a very efficient and economical etching process that yields capacitance values equal to or significantly higher than available foils, without requiring major changes in existing production machinery. The present invention provides high surface enlargement and capacitance gain, comparable to those obtained with a persulfate oxidizing material. Unlike persulfate, however, sulfate is thermally and electrochemically stable and thus easy to maintain. Further, the sulfate ion in the chloride containing solution of the present invention preferentially adsorbs on the aluminum oxide layer on an aluminum surface of the foil and prevents the chloride ion from attacking the foil and causing the pitting potential to increase. Once the pitting starts, and fresh foil surface is exposed to the etch solution, the sulfate ion can boost the tunnel growth speed and generate long tunnels and branch tunnels.

While the above description and following examples are directed to an embodiment of the present invention where a sulfate is added to an etch electrolyte solution to increase the capacitance of aluminum anode foil, sulfate ion can be applied to etch electrolytes to increase the capacitance of other anode foils known to those skilled in the art. For example, the process according to the present invention can be used to increase the capacitance of valve metal anode foils such as aluminum, tantalum, titanium, and columbium (niobium).

Electrolytic capacitors manufactured with anode foils etched according to the present invention may be utilized in ICDs, such as those described in U.S. Pat. No. 5,522,851 to Fayram. An increase in capacitance per unit volume of the electrolytic capacitor will allow for a reduction in the size of the ICD.

Having now generally described the invention, the same will be more readily understood through reference to the following examples which are provided by way of illustration, and are not intended to be limiting of the present invention.

EXAMPLES

Example 1

The effect of sulfate ion concentration in an etch electrolyte solution on resulting foil capacitance was investigated.

More specifically, in a first experiment, foil samples (Table 1) were precleaned in an 0.2% by weight HCl solution and etched in a solution containing 1.3% by weight NaCl, 2.6% by weight $NaClO_4$, sulfate ion (as sodium sulfate) in a concentration varying from 100 ppm to 200 ppm, and glycerin levels varying from 10% to 19% by weight. The samples were etched at a current density of 0.15 A/cm$^2$, and the solid levels for the foils etched were 15.3 g/l. The other etch and widening parameters are shown, along with the resulting capacitance for each of the samples, in Table 1.

TABLE 1

| | | | Etch | | | | Widening | | |
|---|---|---|---|---|---|---|---|---|---|
| Foil No. | Preclean Solution (HCl) | Sulfate Concentration (ppm) | Charge (C/cm$^2$) | Time | Temp. (° C.) | Glycerin Conc. | Charge (C/cm$^2$) | Time | Capacitance (μF) |
| 1970 | 0.2% | 100 | 51 | 5′42″ | 81 | 10% | 76 | 6′26″ | 235.62 |
| 1971 | 0.1% | 100 | 51 | 5′42″ | 81 | 10% | 76 | 6′26″ | 229.32 |
| 1972 | 0.1% | 100 | 61 | 6′41″ | 81 | 10% | 66 | 5′36″ | 234.69 |
| 1973 | 0.1% | 100 | 71 | 7′47″ | 81 | 10% | 66 | 5′36″ | 245.06 |
| 1974 | 0.1% | 100 | 51 | 5′42″ | 81 | 13% | 76 | 6′26″ | 244.26 |
| 1975 | 0.1% | 100 | 61 | 6′41″ | 81 | 13% | 66 | 5′36″ | 245.26 |
| 1976 | 0.1% | 100 | 71 | 7′47″ | 81 | 13% | 66 | 5′36″ | 249.32 |
| 1977 | 0.1% | 100 | 51 | 5′42″ | 81 | 16% | 76 | 6′26″ | 251.00 |
| 1978 | 0.1% | 100 | 61 | 6′41″ | 81 | 16% | 66 | 5′36″ | 241.42 |
| 1979 | 0.1% | 100 | 71 | 7′47″ | 81 | 16% | 66 | 5′36″ | 242.36 |
| 1980 | 0.1% | 100 | 51 | 5′42″ | 81 | 19% | 76 | 6′26″ | 239.47 |
| 1981 | 0.1% | 100 | 61 | 6′41″ | 81 | 19% | 66 | 5′36″ | 240.68 |
| 1982 | 0.1% | 100 | 71 | 7′47″ | 81 | 19% | 66 | 5′36″ | 251.41 |
| 1983 | 0.1% | 100 | 81 | 8′53″ | 81 | 19% | 66 | 5′36″ | 257.09 |
| 1984 | 0.1% | 100 | 51 | 5′24″ | 85 | 19% | 76 | 6′26″ | 232.71 |
| 1985 | 0.1% | 200 | 61 | 6′41″ | 81 | 19% | 66 | 5′36″ | 273.47 |

Aluminum foil samples were precleaned in a 4 liter 0.2% HCl solution for 20 seconds. Etching was conducted in a 16 liter bath containing sulfate ion ($SO_4^{2-}$) as $Na_2SO_4$, NaCl, $NaClO_4$, and glycerin. The aluminum foil samples were formed to 485 V according to a conventional formation process. In the sulfate etch experiments illustrated in Tables 1, 2, and 3, sulfate ion concentration was increased from 100 ppm to 500 ppm, with the other etch parameters kept nearly the same.

In a second experiment, foil samples (Table 2) were precleaned in an 0.2% by weight HCl solution and etched in a solution containing 1.3% by weight NaCl, 2.6% by weight $NaClO_4$, 19% by weight glycerin, and sulfate ion (as sodium sulfate) varying from 200 ppm to 300 ppm. The samples were etched at a current density of 0.15 A/cm$^2$ at a solution temperature of 81° C. The other etch and widening parameters are shown, along with the resulting capacitance for each of the samples, in Table 2.

TABLE 2

| Foil No. | Sulfate Concentration (ppm) | Etch Charge (C/cm$^2$) | Etch Time | Widening Charge (C/cm$^2$) | Widening Time | Capacitance (μF) |
|---|---|---|---|---|---|---|
| 1986 | 200 | 51 | 5'42" | 68 | 5'46" | 246 |
| 1987 | 200 | 51 | 5'42" | 70 | 5'56" | 249 |
| 1988 | 200 | 51 | 5'42" | 72 | 6'06" | 249 |
| 1989 | 200 | 51 | 5'42" | 74 | 6'17" | 246 |
| 1990 | 200 | 61 | 6'41" | 74 | 6'17" | 261 |
| 1991 | 200 | 61 | 6'41" | 72 | 6'06" | 259 |
| 1992 | 200 | 61 | 6'41" | 70 | 5'56" | 256 |
| 1993 | 200 | 61 | 6'41" | 68 | 5'46" | 250 |
| 1994 | 200 | 71 | 7'47" | 68 | 5'46" | 271 |
| 1995 | 200 | 71 | 7'47" | 70 | 5'56" | 268 |
| 1996 | 200 | 71 | 7'47" | 72 | 6'06" | 272 |
| 1997 | 200 | 71 | 7'47" | 74 | 6'17" | 269 |
| 1998 | 300 | 71 | 7'47" | 68 | 5'46" | 274 |
| 1999 | 300 | 61 | 6'41" | 70 | 5'56" | 273 |
| 2000 | 300 | 51 | 5'42" | 72 | 6'06" | 265 |
| 2001 | 300 | 71 | 7'47" | 68 | 5'46" | 281 |

In a third experiment, foil samples (Table 3) were pre-cleaned in an 0.2% by weight HCl solution and etched in a solution containing 1.3% by weight NaCl, 2.6% by weight $NaClO_4$, 20% by weight glycerin, and sulfate ion (as sodium sulfate) varying from 300 ppm to 500 ppm. The samples were etched at a current density of 0.15 A/cm$^2$ at a solution temperature of 80° C. The other etch and widening parameters are shown, along with the resulting capacitance for each of the samples, in Table 3.

TABLE 3

| Foil No. | Sulfate Concentration (ppm) | Etch Charge (C/cm$^2$) | Etch Time | Widening Charge (C/cm$^2$) | Widening Time | Capacitance (μF) |
|---|---|---|---|---|---|---|
| 2343 | 300 | 61 | 6'41" | 70 | 5'56" | 295.78 |
| 2346 | 300 | 81 | 8'53" | 70 | 5'56" | 294.12 |
| 2347 | 300 | 71 | 7'47" | 72 | 6'06" | 296.58 |
| 2348 | 300 | 71 | 7'47" | 74 | 6'17" | 271.76 |
| 2349 | 400 | 61 | 6'41" | 70 | 5'56" | 286.16 |
| 2352 | 400 | 71 | 7'47" | 72 | 6'06" | 300.92 |
| 2353 | 400 | 71 | 7'47" | 74 | 6'17" | 281.05 |
| 2354 | 500 | 61 | 6'41" | 70 | 5'56" | 288.56 |
| 2357 | 500 | 71 | 7'47" | 72 | 6'06" | 308.71 |
| 2358 | 500 | 71 | 7'47" | 74 | 6'17" | 305.49 |

As illustrated in Tables 1, 2, and 3, the resulting foil capacitance increased from 240 μF to nearly 290 μF when the sulfate ion concentration was increased from 100 ppm to 500 ppm.

In another sulfate etch experiment, foil samples (Table 4) were precleaned in an 0.2% by weight HCl solution and etched in a solution containing 1.3% by weight NaCl, 2.6% by weight $NaClO_4$, sulfate ion (as sodium sulfate) concentration varying from 300 ppm to 900 ppm, and glycerin levels varying from 10% by weight to 20% by weight, by similar methods to those for the foil samples illustrated in Tables 1, 2, and 3. The samples were etched at a current density of 0.15 A/cm$^2$, an etch charge of 60 Coulombs/cm$^2$ for 6 minutes, 40 seconds at a solution temperature of 80.5° C. The samples were widened with a charge of 77 Coulombs/cm$^2$ for 6 minutes, 36 seconds. The foils were formed to 465V. The resulting capacitance is for the foil samples is shown in Table 4.

TABLE 4

| Foil No. | Glycerin concentration (%) | Sulfate Concentration (ppm) | Capacitance (μF) |
|---|---|---|---|
| 6052 | 10 | 500 | 278.89 |
| 6053 | 10 | 500 | 284.22 |
| 6054 | 10 | 500 | 289.92 |
| 6055 | 10 | 500 | 286.55 |
| 6056 | 14 | 500 | 297.08 |
| 6057 | 14 | 500 | 291.68 |
| 6058 | 14 | 500 | 292.92 |
| 6059 | 14 | 500 | 291.29 |
| 6060 | 16 | 500 | 292.30 |
| 6061 | 16 | 500 | 293.55 |
| 6062 | 16 | 500 | 294.31 |
| 6063 | 16 | 500 | 294.14 |
| 6064 | 16 | 700 | 299.22 |
| 6065 | 16 | 700 | 300.29 |
| 6066 | 16 | 900 | 300.45 |
| 6067 | 16 | 900 | 289.25 |
| 6068 | 16 | 300 | 288.36 |
| 6069 | 16 | 300 | 291.62 |
| 6070 | 20 | 300 | 304.42 |
| 6071 | 20 | 300 | 288.24 |
| 6072 | 20 | 500 | 298.78 |
| 6073 | 20 | 500 | 298.41 |
| 6074 | 20 | 500 | 294.03 |
| 6075 | 20 | 500 | 297.07 |
| 6076 | 20 | 700 | 294.44 |
| 6077 | 20 | 700 | 296.89 |
| 6078 | 20 | 700 | 299.11 |
| 6079 | 20 | 700 | 293.29 |
| 6080 | 20 | 900 | 302.83 |
| 6081 | 20 | 900 | 299.72 |
| 6082 | 20 | 900 | 296.27 |
| 6083 | 20 | 900 | 299.96 |

The best capacitance for the glycerin levels tested was at 700 ppm sulfate ion concentration.

In another sulfate etch experiment, foil samples (Table 5) were precleaned in an 0.2% by weight HCl solution and etched in a solution containing 1.3% by weight NaCl, 2.6% by weight $NaClO_4$, sulfate ion concentration (as sodium sulfate) varying from 500 ppm to 2000 ppm, at glycerin concentrations of 16% and 20% by weight, by similar methods to those for the foil samples illustrated above in Tables 1-4. The samples were etched at a current density of 0.15 A/cm$^2$, an etch charge of 62 Coulombs/cm$^2$ for 6 minutes, 53 seconds at a solution temperature of 80.5° C. The samples were widened with a charge of 75 Coulombs/cm$^2$ for 6 minutes, 31 seconds. The foils were formed to 465V. The resulting capacitances for the foil samples are shown in Table 5.

TABLE 5

| Foil No. | Glycerin Concentration (%) | Sulfate Concentration (ppm) | Capacitance (μF) |
|---|---|---|---|
| 6142 | 16 | 500 | 280.15 |
| 6143 | 16 | 500 | 282.25 |
| 6144 | 16 | 500 | 287.16 |
| 6145 | 16 | 500 | 279.59 |
| 6146 | 16 | 1000 | 277.31 |
| 6147 | 16 | 1000 | 277.33 |
| 6148 | 16 | 1000 | 278.58 |
| 6149 | 16 | 1000 | 281.94 |
| 6150 | 16 | 1500 | 277.88 |
| 6151 | 16 | 1500 | 282.76 |
| 6152 | 16 | 1500 | 279.01 |
| 6153 | 16 | 1500 | 275.22 |
| 6154 | 16 | 2000 | 277.00 |
| 6155 | 16 | 2000 | 277.28 |
| 6156 | 16 | 2000 | 277.41 |
| 6157 | 16 | 2000 | 280.62 |
| 6158 | 20 | 500 | 286.90 |
| 6159 | 20 | 500 | 285.78 |
| 6160 | 20 | 500 | 286.91 |
| 6161 | 20 | 500 | 283.16 |
| 6162 | 20 | 1000 | 285.37 |
| 6163 | 20 | 1000 | 281.76 |
| 6164 | 20 | 1000 | 283.26 |
| 6165 | 20 | 1000 | 279.29 |
| 6166 | 20 | 1500 | 277.40 |
| 6167 | 20 | 1500 | 277.50 |
| 6168 | 20 | 1500 | 272.62 |
| 6169 | 20 | 1500 | 274.23 |
| 6170 | 20 | 2000 | 279.00 |
| 6171 | 20 | 2000 | 280.90 |
| 6172 | 20 | 2000 | 275.62 |
| 6173 | 20 | 2000 | 271.31 |

The best foil capacitances were found at the sulfate concentration of 500 ppm at both glycerin levels.

It is therefore concluded that a range of sulfate concentration between about 500 and about 700 ppm in the etch process appears to yield the best foil capacitance.

Example 2

On an oxide covered aluminum surface, sulfate ions incorporate into the aluminum oxide layer and retard tunnel initiation. On the other hand, sulfate ions can boost tunnel initiation on fresh corrosion pits. Thus, it was investigated whether a precleaning process preceding the etch process would increase the resulting foil capacitance.

In a sulfate etch experiment, three preclean processes were compared: no preclean, 1% HCl, and 0.5% HCl solution, respectively at room temperature (~25° C.). The precleaning was conducted in a 4 liter HCl solution for 20 seconds. The foil samples (Table 6) were etched in a 16 liter solution containing 1.3% NaCl, 2.6% $NaClO_4$, 20% glycerol, 500 ppm $SO_4^{-2}$, at 0.15 A/cm$^2$. The foil samples were then formed to 459 V according to a conventional formation process. Other etch and widening conditions, and the resulting capacitance of the foils from the experiment are shown in Table 6.

TABLE 6

| | | Etch | | | | Widening | | |
|---|---|---|---|---|---|---|---|---|
| Foil No. | Preclean Solution (HCl) | Charge (C/cm$^2$) | Time | Temp (° C.) | Glycerin Conc. | Charge (C/cm$^2$) | Time | Capacitance (μF) |
| 1940 | 1% | 46 | 5'8" | 81 | 8% | 80 | 6'26" | 168.07 |
| 1941 | 0% | 46 | 5'8" | 81 | 8% | 80 | 6'26" | 256.66 |
| 1944 | 0.5% | 51 | 5'42" | 83 | 8% | 76 | 6'47" | 295.17 |
| 1945 | 0.5% | 46 | 5'8" | 83 | 8% | 80 | 6'26" | 276.89 |
| 1946 | 0.5% | 46 | 5'8" | 85 | 8% | 80 | 6'26" | 286.52 |
| 1947 | 0.5% | 51 | 5'42" | 85 | 8% | 76 | 6'47" | 302.76 |
| 1948 | 0.5% | 46 | 5'8" | 81 | 10% | 80 | 6'26" | 293.26 |
| 1949 | 0.5% | 51 | 5'42" | 81 | 10% | 76 | 6'47" | 302.93 |
| 1950 | 0.5% | 51 | 5'42" | 83 | 10% | 76 | 6'47" | 292.74 |
| 1951 | 0.5% | 51 | 5'42" | 85 | 10% | 76 | 6'47" | 295.63 |
| 1952 | 0.5% | 46 | 5'8" | 81 | 13% | 80 | 6'26" | 286.34 |
| 1953 | 0.5% | 51 | 5'42" | 81 | 13% | 76 | 6'47" | 306.54 |
| 1954 | 0.5% | 51 | 5'42" | 83 | 13% | 76 | 6'47" | 302.86 |
| 1955 | 0.5% | 51 | 5'42" | 85 | 13% | 76 | 6'47" | 304.18 |

The results indicate that precleaning increases the resulting foil capacitance. Precleaning with a 0.5% HCl solution generated the best sheet capacitance of 276 μF, compared to 256 μF for no preclean process and 168 μF for precleaning at a 1% HCl solution.

Further investigation shows 20 seconds immersion time in 0.2% HCl generates the best foil capacitance. It is noted that the best preclean process may change with the foil surface condition. A roll with a thicker surface oxide layer will need a more aggressive preclean process.

Example 3

In a neutral etch process, the chloride ion is responsible for pit initiation and tunnel propagation, and the perchlorate ion acts as an oxidizer to help create high tunnel density and long tunnels. The relative amounts of chloride and perchlorate ions were investigated to determine the effect on resulting foil capacitance with a sulfate etch process.

Two aluminum foils were etched in accordance with the methods according to Example 1 under similar parameters but different $NaClO_4$/NaCl ratios. The first foil was etched in an etch solution of 1.3% by weight NaCl, 3.49% by weight $NaClO_4$, 5% by weight glycerin, and 100 ppm sulfate ion (as sodium sulfate) at an etch charge of 45 Coulombs/cm$^2$ for 5 minutes, 2 seconds at a solution temperature of 81° C. The first foil was then widened with a charge of 87 Coulombs/cm$^2$ for 7 minutes, 23 seconds. The first foil was etched without any precleaning.

The second foil was precleaned in an 0.5% HCl solution, then etched in an etch solution of 1.3% by weight NaCl, 2.6% by weight $NaClO_4$, 8% by weight glycerin, and 400 ppm sulfate ion (as sodium sulfate) at an etch charge of 45 Coulombs/cm$^2$ for 5 minutes, 8 seconds at a solution temperature of 85° C. The second foil was then widened at a charge of 80 Coulombs/cm$^2$ for 6 minutes, 26 seconds.

With a $NaClO_4$/NaCl ratio of 2.7:1, the first foil had a capacitance of 241 μF. With a $NaClO_4$/NaCl ratio of 2:1, the second foil had a capacitance of 286 μF.

In an additional experiment, foil samples (Table 7) were precleaned in an 0.2% HCl solution, and etched in an etch solution of 1.3% to 1.5% by weight NaCl, 2.6% by weight $NaClO_4$, 20% by weight glycerin, and 400 ppm sulfate ion (as sodium sulfate), and with a current density of 0.15 A/cm$^2$, at a solution temperature of 81° C. The glycerin concentration was held constant at 20% by weight. Other parameters of the experiment, as well as the resulting capacitance for the samples are shown below in Table 7.

TABLE 7

| | | Etch | | Widening | | |
|---|---|---|---|---|---|---|
| Foil No. | NaCl | Charge (C/cm$^2$) | Time | Charge (C/cm$^2$) | Time | Capacitance (μF) |
| 3726 | 1.3% | 70 | 7'47" | 72 | 6'07" | 257.84 |
| 3727 | 1.3% | 60 | 6'40" | 72 | 6'07" | 256.97 |
| 3728 | 1.3% | 50 | 5'33" | 72 | 6'07" | 258.8 |
| 3729 | 1.3% | 70 | 7'47" | 74 | 6'18" | 248.19 |

TABLE 7-continued

| Foil No. | NaCl | Etch Charge ($C/cm^2$) | Etch Time | Widening Charge ($C/cm^2$) | Widening Time | Capacitance (μF) |
|---|---|---|---|---|---|---|
| 3730 | 1.3% | 60 | 6'40" | 74 | 6'18" | 257.98 |
| 3731 | 1.3% | 50 | 5'33" | 74 | 6'18" | 257.28 |
| 3732 | 1.3% | 70 | 7'47" | 76 | 6'28" | 266.88 |
| 3733 | 1.3% | 60 | 6'40" | 76 | 6'28" | 256.72 |
| 3734 | 1.3% | 50 | 5'33" | 76 | 6'28" | 254.97 |
| 3735 | 1.3% | 70 | 7'47" | 72 | 6'07" | 268.3 |
| 3736 | 1.3% | 60 | 6'40" | 72 | 6'07" | 262.65 |
| 3737 | 1.3% | 50 | 5'33" | 72 | 6'07" | 251.81 |
| 3738 | 1.3% | 70 | 7'47" | 74 | 6'18" | 250.47 |
| 3739 | 1.3% | 60 | 6'40" | 74 | 6'18" | 259.59 |
| 3740 | 1.3% | 50 | 5'33" | 74 | 6'18" | 254.19 |
| 3741 | 1.5% | 50 | 5'33" | 74 | 6'18" | 246.87 |

In the sulfate etch shown in Table 7, the foil capacitance drops from 254 μF to 247 μF when the $NaClO_4$/NaCl ratio drops from 2:1 to 1.73:1 under the same etch parameters.

It is concluded that the optimal $NaClO_4$/NaCl ratio for the sulfate etch process is about 2:1.

Example 4

The effect of current density on foil capacitance in the sulfate etch process was investigated. In a sulfate etch experiment, aluminum foils were prepared by methods similar to those in Example 1.

In a first experiment, foils (Table 8) were etched at either 0.15 $A/cm^2$ or 0.2 $A/cm^2$, and formed to 475 V. The foils were precleaned in an 0.2% HCl solution, and etched in a solution containing 1.3% by weight NaCl, 2.6% by weight $NaClO_4$, 20% by weight glycerin, and 500 ppm sulfate ion (as sodium sulfate). Other conditions for the experiment, and the resulting capacitance of the foil samples, are shown in Table 8.

TABLE 8

| Foil No. | Current Density ($A/cm^2$) | Etch Charge ($C/cm^2$) | Etch Time | Etch emp (° C.) | Widening Charge ($C/cm^2$) | Widening Time | Capacitance (μF) |
|---|---|---|---|---|---|---|---|
| 3083 | 0.15 | 70 | 7'47" | 80 | 74 | 6'18" | 243.07 |
| 3084 | 0.15 | 70 | 7'47" | 80 | 74 | 6'18" | 245.54 |
| 3085 | 0.15 | 70 | 7'47" | 80 | 74 | 6'18" | 251.12 |
| 3086 | 0.15 | 70 | 7'47" | 80 | 74 | 6'18" | 242.79 |
| 3087 | 0.15 | 70 | 7'47" | 80 | 74 | 6'18" | 257.66 |
| 3088 | 0.15 | 70 | 7'47" | 81 | 74 | 6'18" | 255.5 |
| 3089 | 0.15 | 70 | 7'47" | 81 | 74 | 6'18" | 262.69 |
| 3090 | 0.15 | 70 | 7'47" | 81 | 74 | 6'18" | 270.93 |
| 3091 | 0.15 | 70 | 7'47" | 81 | 74 | 6'18" | 279.06 |
| 3092 | 0.15 | 70 | 7'47" | 81 | 74 | 6'18" | 277.75 |
| 3093 | 0.15 | 70 | 7'47" | 81 | 74 | 6'18" | 277.67 |
| 3094 | 0.15 | 70 | 7'47" | 81 | 74 | 6'18" | 281.54 |
| 3095 | 0.15 | 70 | 7'47" | 81 | 74 | 6'18" | 278.66 |
| 3096 | 0.15 | 70 | 7'47" | 81 | 74 | 6'18" | 276.05 |
| 3097 | 0.15 | 70 | 7'47" | 81 | 74 | 6'18" | 283.22 |
| 3098 | 0.15 | 70 | 7'47" | 81 | 74 | 6'18" | 281.21 |
| 3099 | 0.15 | 70 | 7'47" | 81 | 74 | 6'18" | 277.24 |
| 3100 | 0.15 | 70 | 7'47" | 81 | 74 | 6'18" | 285.13 |
| 3101 | 0.15 | 70 | 7'47" | 81 | 74 | 6'18" | 279.56 |
| 3102 | 0.15 | 70 | 7'47" | 81 | 74 | 6'18" | 278.67 |
| 3103 | 0.15 | 70 | 7'47" | 81 | 74 | 6'18" | 286.62 |
| 3104 | 0.15 | 70 | 7'47" | 81 | 74 | 6'18" | 279.47 |
| 3105 | 0.15 | 70 | 7'47" | 81 | 74 | 6'18" | 274.77 |
| 3106 | 0.15 | 70 | 7'47" | 81 | 74 | 6'18" | 284.75 |
| 3107 | 0.15 | 70 | 7'47" | 81 | 74 | 6'18" | 278.12 |
| 3108 | 0.15 | 70 | 7'47" | 81 | 74 | 6'18" | 273.76 |
| 3109 | 0.15 | 70 | 7'47" | 81 | 74 | 6'18" | 287.46 |
| 3110 | 0.15 | 70 | 7'47" | 81 | 74 | 6'18" | 278.43 |

TABLE 8-continued

| Foil No. | Current Density ($A/cm^2$) | Etch Charge ($C/cm^2$) | Etch Time | Etch emp (° C.) | Widening Charge ($C/cm^2$) | Widening Time | Capacitance (μF) |
|---|---|---|---|---|---|---|---|
| 3111 | 0.15 | 70 | 7'47" | 81 | 74 | 6'18" | 284.37 |
| 3112 | 0.15 | 70 | 7'47" | 81 | 74 | 6'18" | 272.9 |
| 3113 | 0.15 | 70 | 7'47" | 81 | 74 | 6'18" | 277.64 |
| 3114 | 0.15 | 70 | 7'47" | 81 | 74 | 6'18" | 269.61 |
| 3115 | 0.15 | 70 | 7'47" | 81 | 76 | 6'26" | 273.1 |
| 3116 | 0.15 | 70 | 7'47" | 81 | 76 | 6'26" | 271.61 |
| 3117 | 0.15 | 70 | 7'47" | 81 | 76 | 6'26" | 278.63 |
| 3118 | 0.15 | 70 | 7'47" | 81 | 76 | 6'26" | 272.82 |
| 3119 | 0.15 | 70 | 7'47" | 81 | 76 | 6'26" | 274.13 |
| 3120 | 0.2 | 70 | 5'50" | 81 | 76 | 6'26" | 241.9 |
| 3121 | 0.2 | 70 | 5'50" | 81 | 76 | 6'26" | 230.89 |
| 3122 | 0.2 | 70 | 5'50" | 81 | 76 | 6'26" | 249.06 |
| 3124 | 0.2 | 30 | 2'30" | 81 | 70 | 5'56" | 241.49 |
| 3125 | 0.2 | 30 | 2'30" | 81 | 70 | 5'56" | 225.66 |
| 3126 | 0.2 | 30 | 2'30" | 81 | 70 | 5'56" | 224.69 |
| 3127 | 0.2 | 30 | 2'30" | 81 | 70 | 5'56" | 221.69 |
| 3128 | 0.2 | 30 | 2'30" | 81 | 70 | 5'56" | 227.85 |
| 3129 | 0.2 | 30 | 2'30" | 81 | 70 | 5'56" | 227.55 |
| 3130 | 0.2 | 30 | 2'30" | 81 | 70 | 5'56" | 214.7 |

As can be seen from Table 8, foils etched at the current density of 0.15 $A/cm^2$ have a higher capacitance than those etched at 0.2 $A/cm^2$.

In another experiment, foil samples (Table 9) were etched at current densities at 0.15, 0.16 and 0.17 $A/cm^2$ and formed to 475 V. The foils were precleaned in an 0.2% HCl solution, and etched in a solution containing 1.3% by weight NaCl, 2.6% by weight $NaClO_4$, 20% by weight glycerin, and 500 ppm sulfate ion (as sodium sulfate) at an etch charge of 62 Coulombs/$cm^2$ and a solution temperature of 81° C., with 20.4 g/l solids present. The other conditions of the experiment, and the resulting capacitance of the samples, is shown in Table 9.

TABLE 9

| Foil No. | Current Density ($A/cm^2$) | Etch Time | Widening Charge ($C/cm^2$) | Widening Time | Capacitance (μF) |
|---|---|---|---|---|---|
| 4058 | 0.15 | 6'53" | 74 | 6'20" | 305.25 |
| 4059 | 0.16 | 6'29" | 74 | 6'20" | 307.16 |
| 4060 | 0.17 | 6'05" | 74 | 6'20" | 308.53 |
| 4061 | 0.15 | 6'53" | 76 | 6'30" | 315.03 |
| 4062 | 0.16 | 6'29" | 76 | 6'30" | 302.85 |
| 4063 | 0.17 | 6'05" | 76 | 6'30" | 295.59 |
| 4064 | 0.15 | 6'53" | 74 | 6'20" | 310.4 |
| 4065 | 0.16 | 6'29" | 74 | 6'20" | 298 |
| 4066 | 0.17 | 6'05" | 74 | 6'20" | 297.78 |
| 4067 | 0.15 | 6'53" | 76 | 6'30" | 306.28 |
| 4068 | 0.16 | 6'29" | 76 | 6'30" | 296.99 |
| 4069 | 0.17 | 6'05" | 76 | 6'30" | 294.75 |
| 4070 | 0.15 | 6'53" | 74 | 6'20" | 300.97 |
| 4071 | 0.16 | 6'29" | 74 | 6'20" | 285.27 |
| 4072 | 0.17 | 6'05" | 74 | 6'20" | 286.21 |
| 4073 | 0.15 | 6'53" | 76 | 6'30" | 299.34 |
| 4074 | 0.16 | 6'29" | 76 | 6'30" | 284.69 |
| 4075 | 0.17 | 6'05" | 76 | 6'30" | 291.24 |
| 4076 | 0.17 | 6'05" | 74 | 6'20" | 306.59 |
| 4077 | 0.16 | 6'29" | 74 | 6'20" | 307.27 |
| 4078 | 0.15 | 6'53" | 74 | 6'20" | 303.43 |

As can be seen from Table 9, the best foil capacitance was observed at a current density of 0.15 A/cm$^2$.

Example 5

The effect of formation voltages on resulting foil capacitance was investigated. Foils were prepared by methods similar to those in Example 1, and formed to 465 V, 475 V, 485 V, and 495 V.

In a first experiment, aluminum foils were formed to 465 V. The samples were precleaned in an 0.2% HCl solution for 20 seconds and etched in a solution containing 1.3% NaCl, 2.6% $NaClO_4$, 20% glycerin and 500 ppm sulfate ion (as sodium sulfate) at a current density of 0.15 A/cm$^2$, an etch charge of 60 Coulombs/cm$^2$ for 6 minutes, 40 seconds at a solution temperature of 80.5° C. The foils were formed and widened with a charge of 77 Coulombs/cm$^2$ for 6 minutes, 36 seconds. The resulting capacitance of the foil samples is shown at Table 10.

TABLE 10

| Foil No. | Capacitance (μF) |
|---|---|
| 5940 | 305.51 |
| 5941 | 309.78 |
| 5942 | 312.12 |
| 5943 | 306.69 |
| 5944 | 312.06 |
| 5945 | 310.02 |
| 5946 | 309.57 |
| 5947 | 310.46 |
| 5948 | 310.99 |
| 5949 | 307.91 |
| 5950 | 307.50 |
| 5951 | 307.46 |
| 5952 | 308.79 |
| 5953 | 309.20 |
| 5954 | 305.64 |
| 5955 | 309.17 |
| 5956 | 307.36 |
| 5957 | 308.88 |
| 5958 | 310.10 |
| 5959 | 307.04 |
| 5960 | 307.23 |
| 5961 | 307.25 |
| 5962 | 307.90 |
| 5963 | 313.59 |
| 5964 | 311.07 |
| 5965 | 303.84 |
| 5966 | 308.34 |
| 5967 | 306.43 |
| 5968 | 308.67 |
| 5969 | 311.76 |
| 5970 | 310.82 |
| 5971 | 306.35 |

In a second experiment, aluminum foils (Table 11) were formed to 495 V. The samples were precleaned in an 0.2% HCl solution for 20 seconds and etched in a solution containing 1.3% NaCl, 2.6% $NaClO_4$, 20% glycerin and 500 ppm sulfate ion (as sodium sulfate) at a current density of 0.15 A/cm$^2$, an etch charge of 62 Coulombs/cm$^2$ for 6 minutes, 53 seconds at a solution temperature of 80.5° C. The widening parameters, and the resulting capacitance of the foil samples are shown in Table 11, below.

TABLE 11

| | Widening | | |
|---|---|---|---|
| Foil No. | Charge (C/cm$^2$) | Time | Capacitance (μF) |
| 5665 | 75 | 6'26" | 254.50 |
| 5666 | 75 | 6'26" | 270.15 |
| 5667 | 75 | 6'26" | 277.45 |
| 5668 | 75 | 6'26" | 278.17 |
| 5669 | 75 | 6'26" | 275.31 |
| 5670 | 75 | 6'26" | 277.67 |
| 5671 | 75 | 6'26" | 276.20 |
| 5672 | 75 | 6'26" | 279.38 |
| 5673 | 75 | 6'26" | 281.52 |
| 5674 | 75 | 6'26" | 282.69 |
| 5675 | 75 | 6'26" | 280.57 |
| 5676 | 75 | 6'26" | 281.90 |
| 5677 | 77 | 6'36" | 286.85 |
| 5678 | 77 | 6'36" | 280.01 |
| 5679 | 77 | 6'36" | 283.98 |
| 5680 | 77 | 6'36" | 282.12 |
| 5681 | 77 | 6'36" | 272.20 |
| 5682 | 77 | 6'36" | 275.64 |
| 5683 | 77 | 6'36" | 282.36 |
| 5684 | 77 | 6'36" | 282.59 |
| 5685 | 77 | 6'36" | 282.29 |
| 5686 | 77 | 6'36" | 277.85 |
| 5687 | 77 | 6'36" | 280.35 |
| 5688 | 77 | 6'36" | 287.71 |

In a third experiment, aluminum foils (Table 12) were formed to 475 V. The samples were precleaned in an 0.2% HCl solution for 20 seconds and etched in a solution containing 1.3% NaCl, 2.6% $NaClO_4$, 20% glycerin and 500 ppm sulfate ion (as sodium sulfate) at an etch charge of 62 Coulombs/cm$^2$ at a solution temperature of 81° C., at a 20.4 g/l solids level. The other etch and widening parameters, as well as the resulting capacitance for the samples tested, are shown in Table 12, below.

TABLE 12

| | Current Density | Etch | Widening | | Capacitance |
|---|---|---|---|---|---|
| Foil No. | (A/cm$^2$) | Time | Charge (C/cm$^2$) | Time | (μF) |
| 4058 | 0.15 | 6'53" | 74 | 6'20" | 305.25 |
| 4059 | 0.16 | 6'29" | 74 | 6'20" | 307.16 |
| 4060 | 0.17 | 6'05" | 74 | 6'20" | 308.53 |
| 4061 | 0.15 | 6'53" | 76 | 6'30" | 315.03 |
| 4062 | 0.16 | 6'29" | 76 | 6'30" | 302.85 |
| 4063 | 0.17 | 6'05" | 76 | 6'30" | 295.59 |
| 4064 | 0.15 | 6'53" | 74 | 6'20" | 310.4 |
| 4065 | 0.16 | 6'29" | 74 | 6'20" | 298 |
| 4066 | 0.17 | 6'05" | 74 | 6'20" | 297.78 |
| 4067 | 0.15 | 6'53" | 76 | 6'30" | 306.28 |
| 4068 | 0.16 | 6'29" | 76 | 6'30" | 296.99 |
| 4069 | 0.17 | 6'05" | 76 | 6'30" | 294.75 |
| 4070 | 0.15 | 6'53" | 74 | 6'20" | 300.97 |
| 4071 | 0.16 | 6'29" | 74 | 6'20" | 285.27 |
| 4072 | 0.17 | 6'05" | 74 | 6'20" | 286.21 |
| 4073 | 0.15 | 6'53" | 76 | 6'30" | 299.34 |
| 4074 | 0.16 | 6'29" | 76 | 6'30" | 284.69 |
| 4075 | 0.17 | 6'05" | 76 | 6'30" | 291.24 |
| 4076 | 0.17 | 6'05" | 74 | 6'20" | 306.59 |
| 4077 | 0.16 | 6'29" | 74 | 6'20" | 307.27 |
| 4078 | 0.15 | 6'53" | 74 | 6'20" | 303.43 |

In a fourth experiment, aluminum foils (Table 13) were formed to 485 V. The samples were precleaned in an 0.2% HCl solution for 20 seconds, etched in a solution containing 1.3% NaCl, 2.6% $NaClO_4$, 20% glycerin and 500 ppm sulfate ion (as sodium sulfate) at an etch charge of 71 Coulombs/cm$^2$ and a current density of 0.15 A/cm$^2$ at a solution temperature of 81° C., widened at 74 Coulombs/cm$^2$ and formed to 485 V, by methods similar to those in Example 1. The resulting capacitance for the samples tested is shown in Table 13, below.

TABLE 13

| Foil No. | Capacitance (μF) |
|---|---|
| 1338 | 269.24 |
| 1339 | 279.6 |
| 1340 | 268.52 |
| 1341 | 278.03 |
| 1342 | 271.11 |
| 1343 | 289.76 |
| 1344 | 290.41 |
| 1345 | 302.99 |
| 1346 | 291.63 |
| 1348 | 285.22 |
| 1349 | 283.14 |
| 1350 | 281.47 |
| 1351 | 290.49 |
| 1352 | 283.46 |
| 1353 | 279.12 |

These experiments showed sufficient foil capacitance produced at the differing forming voltages.

Example 6

Figure 1B:
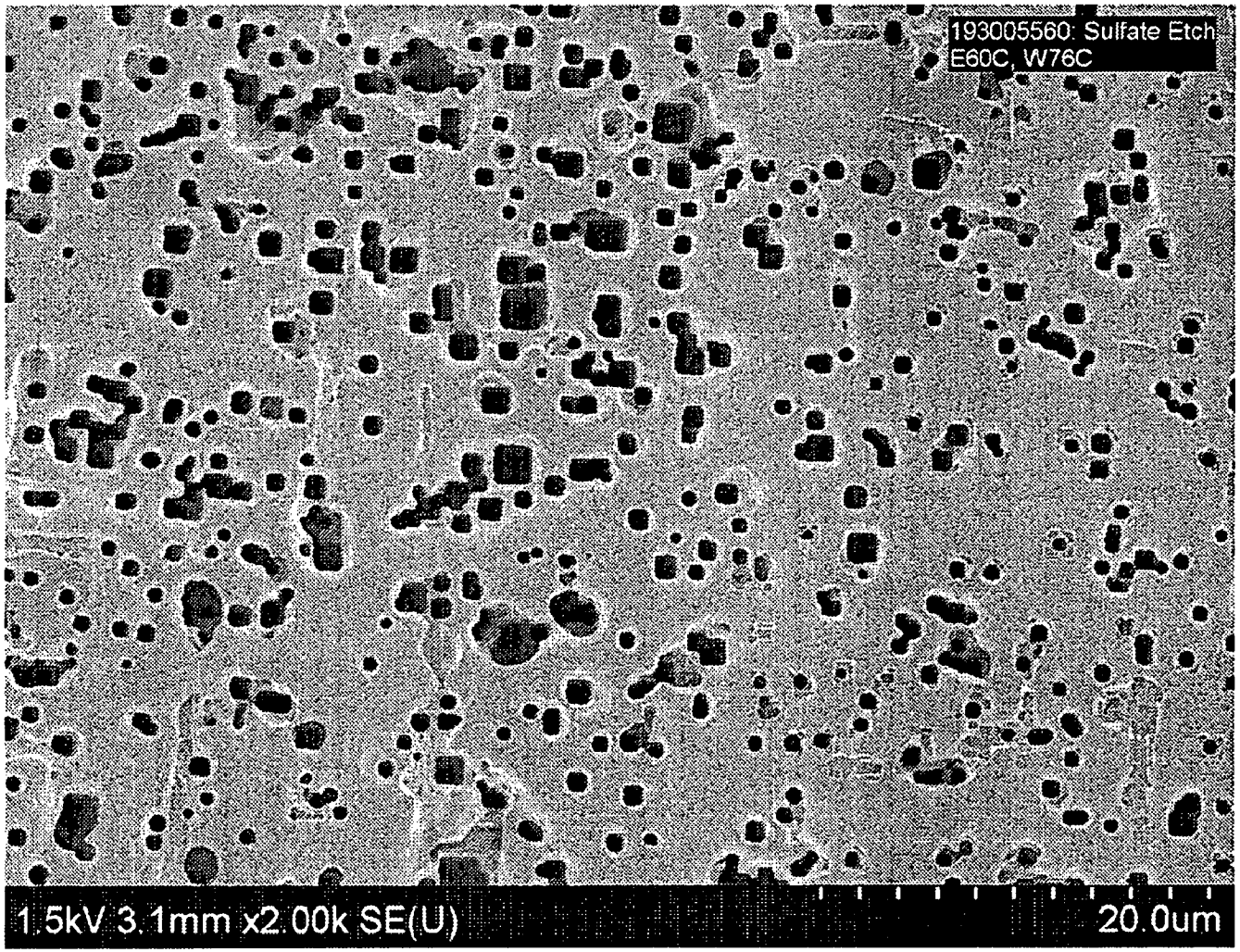

Aluminum foils were etched at 60 Coulombs/cm$^2$ using a sulfate etch process and widened at 76 Coulombs/cm$^2$ by methods similar to those Example 1. The foils were then electropolished in a perchloric electropolish solution for 1 minute. FIGS. 1A and 1B show the SEM images of the etched foil surface. The tunnel density is around 20 M/cm$^2$ when counted automatically by Scion Image software (Scion Corp., Frederick, Md.). With this software, the tunnels are counted as one if they merge together.

The cross-section of the sulfate etch foil was made either by stacking the foil in the epoxy disk and polishing the cross section, or simply by breaking the foil. In both cases, the aluminum inside the formed foil was dissolved in 1 N sodium hydroxide solution. The leftover oxide replica of the foil cross-section was coated with 2 to 4 nm of Pd—Ir alloy before the SEM study.

Figure 2A:
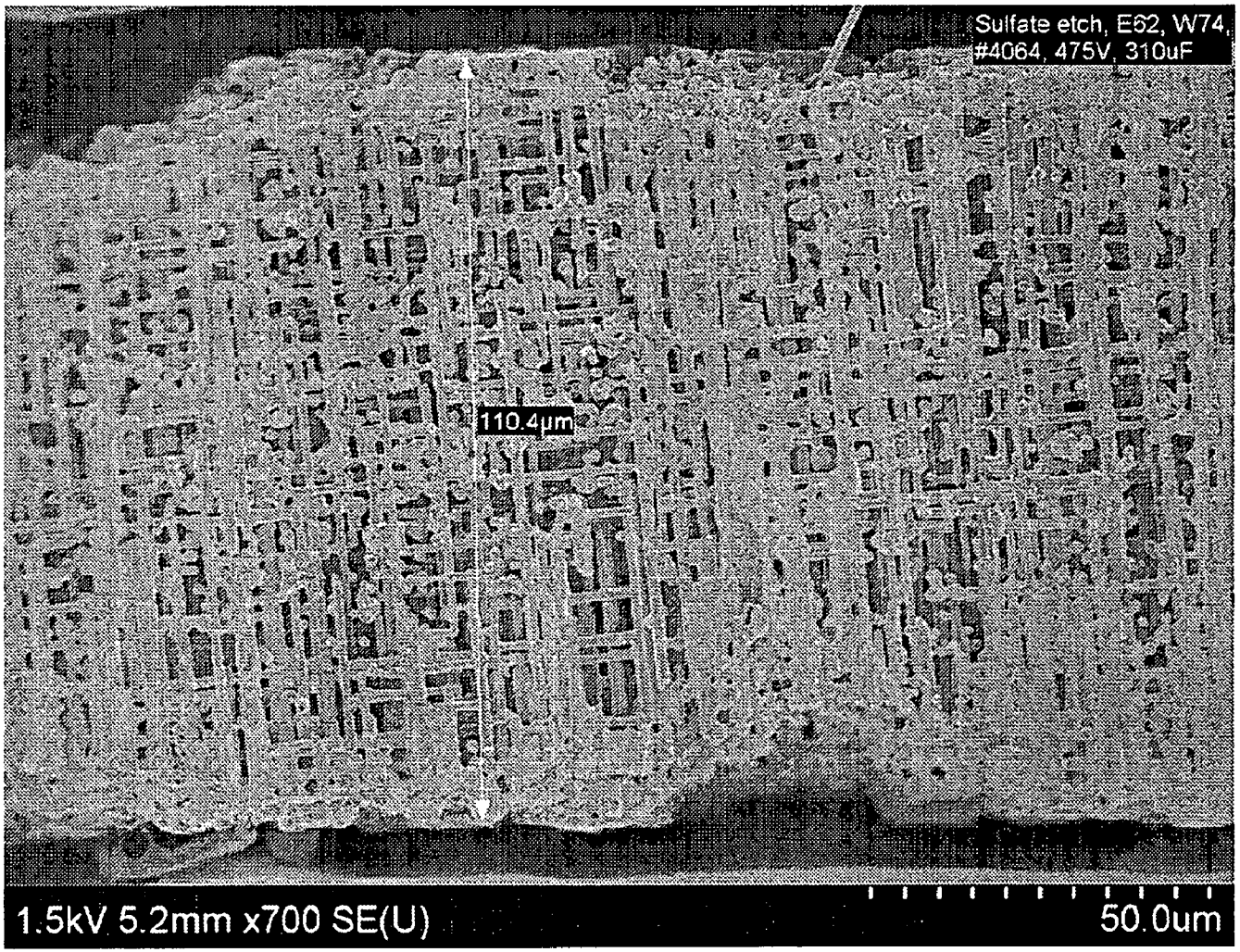
FIGS. 2A and 2B illustrate SEM cross-sectional images of sulfate etched foil surface after formation, according to the present invention.
Figure 2B:
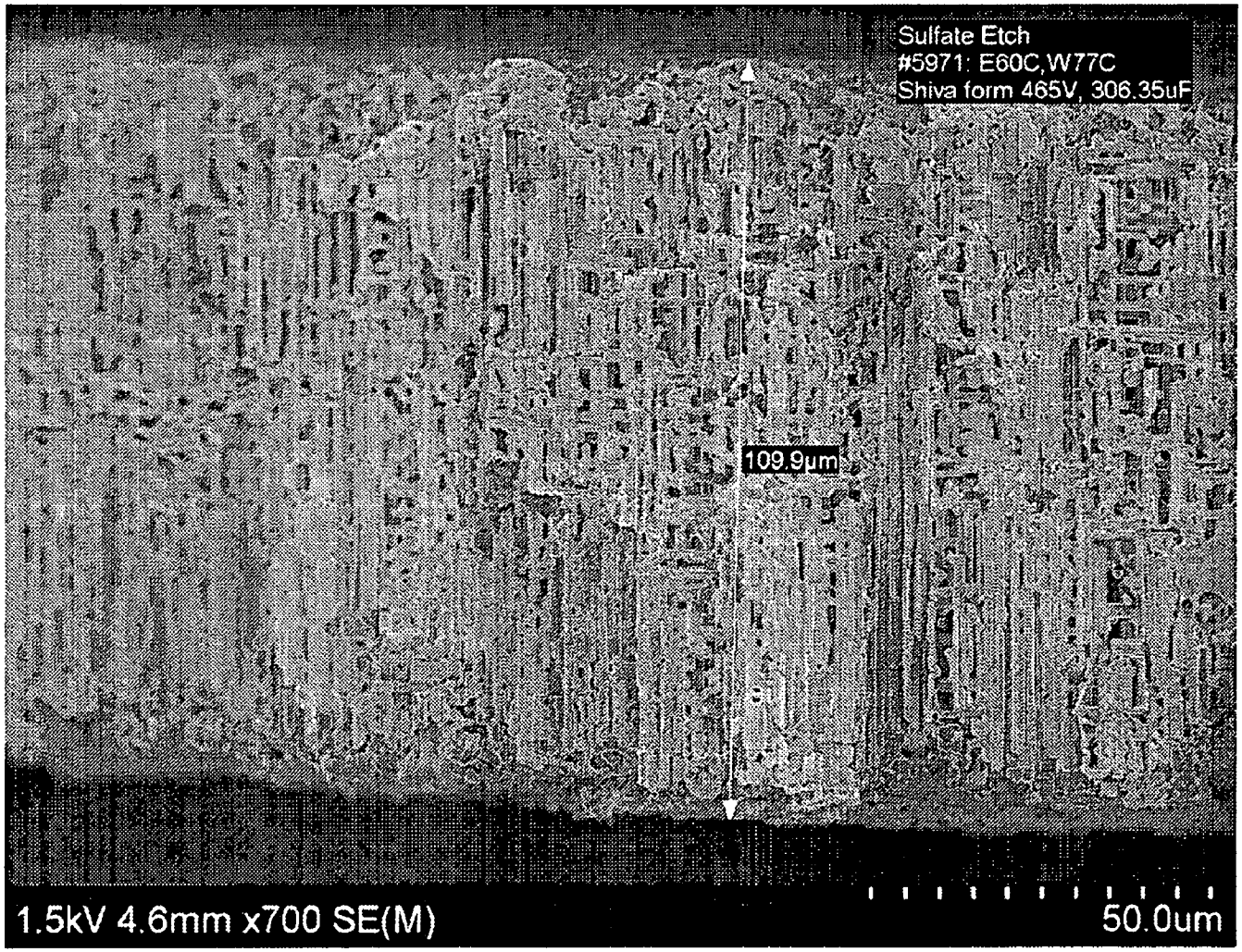

FIGS. 2A and 2B show the SEM images of the sulfate etch foil cross-sections. High tunnel density is observed, with many horizontal branch tunnels such as those seen in foils prepared using a conventional persulfate etch process. Big corrosion pits can be seen on the foil surface. A lot of through tunnels can be found in these corrosion pits.

Example 7

Capacitors using the sulfate etched foils were prepared. Table 14 lists the test data for capacitors prepared using foils from Table No. 13.

TABLE 14

| Sample # | Leakage Current @ 1 min. (A) | Leakage Current @ 5 min. (A) | Charge Time | Charge efficiency | Droop @ 3 sec. | Droop @ .25 sec. | Total Delivered Energy | Total Stored Energy | Ratio Delivered/ Stored Energy |
|---|---|---|---|---|---|---|---|---|---|
| 2192 | 155 | 88 | 8.0 | 81.2 | 8.1 | 1.0 | 14.44 | 15.53 | 0.9298 |
| 2193 | 228 | 118 | 8.3 | 81.0 | 7.3 | 1.0 | 14.88 | 16.07 | 0.9259 |
| 2194 | 122 | 38 | 8.2 | 81.2 | 7.1 | 0.7 | 14.74 | 15.89 | 0.9276 |
| 2196 | 142 | 74 | 8.4 | 80.7 | 7.3 | 0.7 | 15.11 | 16.31 | 0.9264 |
| 2197 | 149 | 77 | 8.4 | 79.9 | 7.6 | 0.7 | 15.10 | 16.37 | 0.9224 |

Table 15 is test data for capacitors prepared using foils from Table 10.

TABLE 15

| Sample # | Leakage Current @ 1 min. (A) | Leakage Current @ 5 min. (A) | Charge Time | Charge efficiency | Droop @ 3 sec. | Droop @ .25 sec. | Total Delivered Energy | Total Stored Energy | Ratio Delivered/ Stored Energy |
|---|---|---|---|---|---|---|---|---|---|
| 221 | 338 | 242 | 9.0 | 78.2 | 9.3 | 1.0 | 15.68 | 17.02 | 0.9212 |
| 222 | 336 | 241 | 8.8 | 77.7 | 10.5 | 1.2 | 15.30 | 16.61 | 0.9211 |
| 223 | 277 | 185 | 8.8 | 77.9 | 9.6 | 1.0 | 15.31 | 16.71 | 0.9162 |
| 224 | 281 | 191 | 8.8 | 78.2 | 9.6 | 1.2 | 15.23 | 16.58 | 0.9185 |
| 225 | 324 | 234 | 8.9 | 77.9 | 10.0 | 1.0 | 15.34 | 16.70 | 0.9185 |
| 226 | 315 | 221 | 9.0 | 78.2 | 10.7 | 1.5 | 15.62 | 16.91 | 0.9237 |
| 227 | 302 | 217 | 9.0 | 78.6 | 10.0 | 1.0 | 15.80 | 17.01 | 0.9288 |

The capacitors prepared as shown in Tables 14 and 15 provide sufficient energy and delivered/stored ratios for ICDs.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents. Additionally, all references cited herein, including journal articles or abstracts, published or corresponding U.S. or foreign patent applications, issued U.S. or foreign patents, or any other references, are each entirely incorporated by reference herein, including all data, tables, figures, and text presented in the cited references.

The foregoing description of the specific embodiments will so fully reveal the general nature of the invention that others can, by applying knowledge within the skill of the art (including the contents of the references cited herein), readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance presented herein, in combination with the knowledge of one of ordinary skill in the art.

It must be noted that as used in the present disclosure and in the appended claims, the singular forms "a", "an", and "the" include plural reference unless the context clearly dictates otherwise. Illustratively, the term "a sulfate" is intended to include one or more sulfates, including mixtures thereof (e.g., sodium sulfate, potassium sulfate, and/or mixtures thereof) and the term "a halide" is intended to include one or more halides, including mixtures thereof (e.g. sodium chloride, potassium chloride, and lithium chloride, and/or mixtures thereof).

What is claimed is:

1. A method of etching an aluminum anode foil, comprising: (a) treating the anode foil in an aqueous electrolyte bath composition comprising a sulfate, selected from the group consisting of sodium sulfate, potassium sulfate, and lithium sulfate, and mixtures thereof, an oxidizing agent comprising sodium perchlorate, and a halide; and (b) passing a direct current (DC) charge through the anode foil while the foil is immersed in the electrolyte bath; such that the anode foil is etched, wherein the DC charge has a current density ranging from about 0.1 A/cm$^2$ to about 0.2 A/cm$^2$, and wherein the electrolyte bath composition comprises sulfate in an amount ranging from about 700 parts per million (ppm) to about 2000 ppm.

2. The method of claim 1, wherein the electrolyte bath composition comprises sodium sulfate.

3. The method of claim 1, wherein the halide is sodium chloride.

4. The method of claim 3, wherein the electrolyte bath composition comprises sodium perchlorate in an amount ranging from about 2 percent to about 12 percent by weight and sodium chloride in an amount ranging from about 1 percent to about 6 percent by weight.

5. The method of claim 4, wherein the electrolyte bath composition comprises sodium perchlorate and sodium chloride in a weight ratio of about 2 to 1.

6. The method of claim 5, wherein the sulfate is sodium sulfate.

7. The method of claim 1, wherein the electrolyte bath composition further comprises a surface-active, viscosity-modifying agent.

8. The method of claim 7, wherein the surface-active, viscosity-modifying agent comprises glycerin.

9. The method of claim 8, wherein the electrolyte bath composition comprises glycerin in an amount ranging from about 0.5% to about 50%.

10. The method of claim 9, wherein the sulfate is sodium sulfate.

11. The method of claim 1, wherein the electrolyte bath composition has a temperature ranging from about 60° C. to about 95° C.

12. The method of claim 1, wherein the DC charge ranges from about 20 coulombs/cm$^2$ to about 100 coulombs/cm$^2$.

13. The method of claim 1, wherein the sulfate is sodium sulfate, the halide is sodium chloride and wherein the electrolyte bath composition further comprises glycerin.

14. The method of claim 13, wherein the electrolyte bath composition comprises about 700 ppm sodium sulfate, about 2.6 percent by weight sodium perchlorate; about 1.3 percent by weight sodium chloride, and about 20 percent by weight glycerin.

15. The method of claim 1, further comprising the step of precleaning the foil prior to the treating step.

16. The method of claim 15, wherein precleaning the foil comprises the step of immersing the foil in a solution comprising HCl.

17. The method of claim 16, wherein precleaning the foil further comprises the step of rinsing the foil in deionized water.

18. The method of claim 15, comprising the steps of immersing the foil in a solution comprising HCl in an amount ranging from about 0.1 percent to about 2 percent by weight for an amount of time ranging from about 20 seconds to about 120 seconds, and rinsing the foil in deionized water for at least about 1 minute.

19. The method of claim 1, further comprising filtering the electrolyte bath composition to maintain a solids level in the electrolyte bath composition of about 5 g/L to about 40 g/L.

20. The method of claim 19, further comprising the step of passing the electrolyte bath composition through a medium having a pore size ranging from about 25 microns to about 40 microns.

21. The method of claim 1, wherein said anode foil is capable of being used in an electrolytic capacitor at a voltage of about 400 Volts or higher.

22. A method of etching an aluminum anode foil, comprising: (a) precleaning the anode foil in a solution comprising HCl; (b) treating the anode foil in an aqueous electrolyte bath composition comprising sodium sulfate, sodium perchlorate, sodium chloride, and glycerin; and (c) passing a DC charge through the anode foil while the foil is immersed in the electrolyte bath; such that the anode foil is etched, wherein the DC charge has a current density ranging from about 0.1 A/cm$^2$ to about 0.2 A/cm$^2$, and wherein the electrolyte bath composition comprises sodium sulfate in an amount ranging from about 700 ppm to about 2000 ppm.

23. The method of claim 22, wherein the electrolyte bath composition comprises sodium perchlorate in an amount ranging from about 2 percent to about 12 percent by weight, sodium chloride in an amount ranging from about 1 percent to about 6 percent by weight, and glycerin in an amount ranging from about 0.5 percent to about 50 percent, and wherein the weight ratio of sodium perchlorate to sodium chloride is about 2 to 1.

24. The method of claim 23, wherein the electrolyte bath composition comprises about 700 ppm sodium sulfate, about 2.6 percent by weight sodium perchlorate, about 1.3 percent by weight sodium chloride, and about 20 percent by weight glycerin.

25. The method of claim 24, wherein the electrolyte bath composition has a temperature between about 80° C. and about 81° C.

26. The method of claim 25, wherein the DC charge has a current density of about 0.15 A/cm$^2$.

27. The method of claim 26, further comprising filtering the bath composition to maintain a solids level in the electrolyte bath composition of about 5 g/L to about 40 g/L.

28. A method of etching an aluminum anode foil, comprising: (a) precleaning the anode foil in a precleaning solution comprising about 0.1 percent to about 2.0 percent by weight HCl, $H_2SO_4$, or $H_3PO_4$ for about 20 to about 120 seconds at a temperature of between about 10° C. to about 30° C.; (b) rinsing the anode foil in deionized water for at least about 1 minute; (c) treating the anode foil in an aqueous electrolyte bath composition comprising: from about 700 to about 2000 ppm sodium sulfate; from about 2 percent to about 6 percent by weight sodium perchlorate; from about 1 percent to about 3 percent by weight sodium chloride, wherein the weight ratio of sodium perchlorate to sodium chloride is about 2 to 1; and from about 5.5 percent to 30 percent by weight glycerin; and (d) passing a DC charge through the anode foil while the foil is immersed in the electrolyte bath; such that the anode foil is etched.

29. The method of claim 28, wherein the precleaning solution comprises about 0.2 percent by weight HCl and wherein the electrolyte bath composition comprises about 700 ppm sodium sulfate, about 2.6 percent by weight sodium perchlorate, about 1.3 percent by weight sodium chloride, and about 20 percent by weight glycerin.

30. The method of claim 29, wherein the electrolyte bath composition has a temperature between about 80° C. and about 81° C.

31. The method of claim 30, wherein the DC charge has a current density of about 0.15 A/cm$^2$.

32. The method of claim 31, further comprising filtering the bath composition to maintain a solids level in the electrolyte bath composition of about 5 g/L to about 40 g/L.

33. The method of claim 32 wherein the charge ranges from about 20 to about 100 coulombs/cm$^2$.

34. The method of claim 33 wherein the charge ranges from about 60 to about 70 coulombs/cm$^2$.

* * * * *